US006834995B1

(12) United States Patent
Stevens

(10) Patent No.: US 6,834,995 B1
(45) Date of Patent: Dec. 28, 2004

(54) BULK BAG HAVING A PAIR OF LOOPS TO SECURE THE DISCHARGE OPENING IN A CLOSED POSITION

(75) Inventor: Graham Andrew Stevens, Bibra Lake (AU)

(73) Assignee: KMCC Western Australia Pty Ltd, Oklahoma City, OK (US)

( * ) Notice: Subject to any disclaimer, the term of this patent is extended or adjusted under 35 U.S.C. 154(b) by 20 days.

(21) Appl. No.: 10/619,701

(22) Filed: Jul. 14, 2003

(51) Int. Cl.[7] ..... B65D 33/00

(52) U.S. Cl. ..... 383/41; 383/24; 383/67; 383/86

(58) Field of Search ..... 383/41, 67, 22, 383/24, 86; 232/43.1, 43.4; 24/306, 442

(56) References Cited

U.S. PATENT DOCUMENTS 3,827,471 A * 8/1974 Gregory et al. ..... 222/181.3
4,862,563 A * 9/1989 Flynn ..... 24/442
5,286,112 A * 2/1994 Bible ..... 383/86
5,344,048 A * 9/1994 Bonerb ..... 222/105
6,431,753 B1 8/2002 Rogers
6,467,955 B1 * 10/2002 Kim ..... 383/20

* cited by examiner

*Primary Examiner*—Robin A. Hylton

(57) ABSTRACT

A bulk bag for flowable goods characterized in that the discharge opening for the bag is held securely for transport and handling by a pair of interlocking first and second loops disposed on the discharge means and bag side, respectively, the second loops being capable of being remotely opened by release of a releasable attachment of a first portion of the second loop to a second portion of such loop, and further wherein a strap is provided having a first, upper end securely attached to the bag side above each of said second loops and a second, lower end which is releasably secured to each second loop.

10 Claims, 5 Drawing Sheets

BULK BAG HAVING A PAIR OF LOOPS TO SECURE THE DISCHARGE OPENING IN A CLOSED POSITION

FIELD OF THE INVENTION

The present invention generally relates to flexible intermediate bulk containers for the transport and discharge of flowable goods, commonly referred to as "bulk bags". More specifically, the present invention relates to those bulk bags in which a means for discharging the goods from the bag is releasably secured to the side of the bag for transport, hereinafter the "side discharge bulk bags".

BACKGROUND

Various forms of bulk bags are known in the field of transportation of flowable goods, whether foodstuffs such as rice, sugar and the like or chemical products such as titanium dioxide pigments. Such bulk bags are typically made of strong flexible fabric capable of supporting a heavy weight of such goods without rupturing. Such bags may be equipped with strong lifting loops. Such bags may have strong webbing reinforcing the fabric. Typically such bags have closable openings at the top and bottom, with the top opening normally being used to fill the bag with the flowable goods and the bottom opening normally being used to discharge the goods from the bag.

Discharge of the material from the bag is normally accomplished by lifting the bag by lifting loops provided at the top end of the bag, suspending the bag via the lifting loops over a receiving container, for example, a hopper equipped with an auger for moving the goods from the hopper to a continuous process, and then releasing the goods into the receiving container by the discharge means provided.

A typical discharge means may be a flap of material associated with the bottom of the bag which is folded over the bottom, discharge opening during transport of the goods, but which is released when discharge is desired. A more favored discharge means includes a closable discharge chute or spout associated with the bottom of the bag and which is secured to the bag's side in transport, but released and opened when discharge of the goods is desired.

As related in U.S. Pat. No. 6,431,753 B1 (Rogers et al.), various attempts have been made over time to provide discharge means (in side discharge bags) that are sufficiently secure as to avoid loss of the goods in transit, but which can nevertheless be remotely actuated with ease to effect a purposeful discharge of the goods from the bag.

In keeping with these objectives, the '753 Rogers et al. patent (hereafter, the '753 patent) proposes side discharge bags wherein a discharge means associated with the bottom of the bag and including a plurality of first loops of fabric is folded to a side of the bag and releasably held in place by being "interlocked" with second fabric loops having a first end attached to the side of the bag and a second end releasably attached to the first end through, for example, a conventional hook-and-loop style closure. In preferred embodiments, and with particular reference now to FIG. 1 and especially FIG. 2 (Prior Art), the bag is secured against inadvertent discharge of the goods therein in transit by transversely disposed, also releasable locking loops 204 which are secured over the sets of first and second loops 202 and 203, respectively, after these have been interlocked. The bag shown in FIGS. 1 and 2 further includes a closable discharge spout which is equipped with a drawstring 301, the excess length of which (when the discharge chute is closed) is secured against the bag side 101 by a strap of material 303 having one end attached to the bag side 101 and a second end again releasably attached to the first end.

The strap of material 303 is positioned such that the excess drawstring length is preferably covered by the discharge chute when the bag and its contents are secured for transport, and the drawstring 301 is maintained in a closed, tightened condition by a rope lock (B-loc) 304. Rope lock 304 is described as remotely releasable by lanyard 305 when it is desired to discharge the goods from the bag.

SUMMARY OF THE INVENTION

The present invention provides an improved bulk bag, wherein the discharge means is held more securely in place prior to use of the same for discharging the flowable goods from the bag. Fundamentally, interlockable first and second loops associated with the discharge end and side of the bag, respectively, are secured after being interlocked through releasable engagement of a second loop in such combination with a strap having a first end securely attached to the bag side above the interlocked first and second loops and having a second end which is releasably attached to the second loop in an interlocked condition of the first and second loops.

By this arrangement, the means for securing or locking the first and second loops in an interlocked condition, namely the strap, is not as exposed (in contrast with the '753 patent's transverse locking loops) to being caught and inadvertently opened or disengaged as the bag is lifted or lowered by the lifting loops, and the strap by its attachment to the second loop provides reinforcement of the hook and loop closure by which the second loop has been formed, in relation to the stress placed thereon by the weight of the goods in the bag (the ends of transverse locking loops 204 in the '753 patent are described as releasably attached to one another, but there is no suggestion of a releasable attachment to the second loops 203).

BRIEF DESCRIPTION OF THE DRAWINGS

The present invention will be better understood by reference to the drawings, wherein.

DETAILED DESCRIPTION OF PREFERRED EMBODIMENTS OF THE INVENTION

Figure 1:
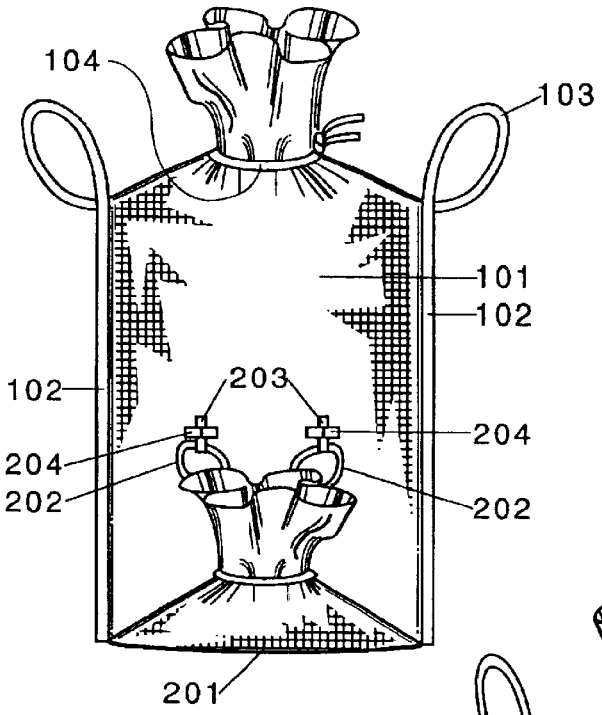
Fig. 1 (PRIOR ART)
FIG. 1 is reproduced from FIG. 1 of the '753 patent, and shows a plan view of that side of a preferred side discharge bag according to the teachings of the '753 patent to which the discharge means is releasably secured (hereinafter referred to as the "front" side of such a bag)
Figure 2:
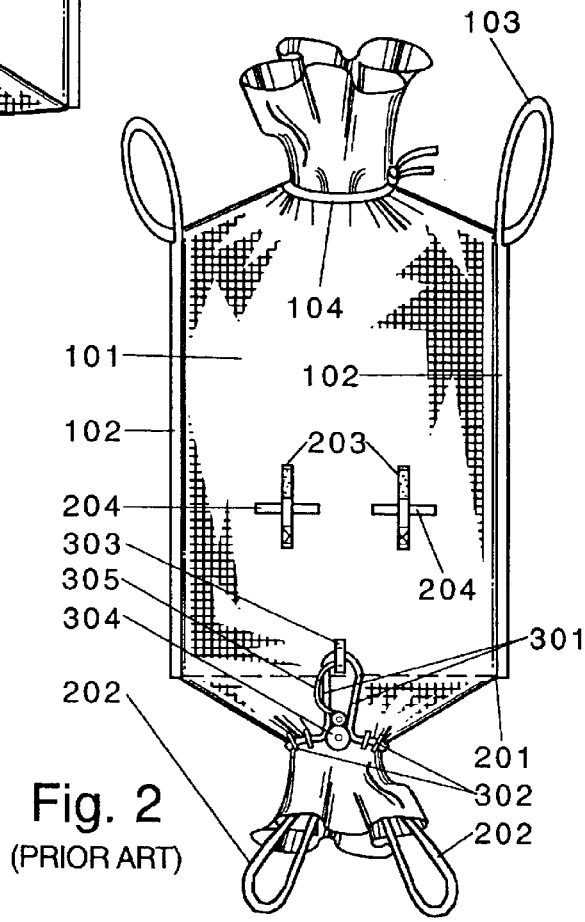
Fig. 2 (PRIOR ART)
FIG. 2 is reproduced from FIG. 2 of the '753 patent, and shows the bag of FIG. 1 with the discharge means released from the side of the bag but with the drawstring closure not yet opened.

Referring now to FIGS. 1 and 2, the present invention as shown in FIGS. 3 through 8 is perhaps most easily understood by contrast with the bulk bag of the '753 patent. Unless otherwise indicated, the features and elements described with reference to the bag of FIGS. 1 and 2 will be understood as applying also to the inventive bags shown in FIGS. 3 through 8.

With this background in mind, a side discharge bag is shown in FIG. 1 with sides 101 comprised of any strong, flexible, burst resistant fabric, for example, a fabric of woven strips of polypropylene. Disposed inside of sides 101 may optionally be a moisture impervious liner (not shown), which may be attached to the interior of sides 101 by various means including gluing, stitching or both. The top, sides or bottom of the bag may be reinforced by strapping 102 of a strong material such as woven polypropylene, polyester, nylon or the like. Lifting loops 103 are securely attached at or near the top of the bag by stitching, gluing, riveting or like means, and are typically comprised of a strong material for supporting the weight of the filled bag, for example, woven polypropylene, polyester, nylon or the like. A closable opening 104 is provided at the top of the bag for filling the bag with flowable goods.

The bottom of the bag is equipped with a closable opening in the form of a discharge chute equipped with a drawstring closure, the discharge chute having attached thereto at a terminal, bottom edge (preferably permanently, by stitching, gluing, riveting or like means) a plurality of first or bottom loops 202, each of which is designed to be interlocked with a mating side or second loop 203 which are formed on the side of the bag. Second or side loops 203 are described in the '753 patent as preferably securely attached at a first, upper end to the bag side, with the second end of the loop 203 being designed to be releasably attached either to this first end of the loop 203 or to the side of the bag itself proximate the first end through hook and loop-type fastening material, snaps, buttons or like releasable fastening means. First and second loops 202 and 203, respectively, are again described as preferably made from a strong, flexible material such as woven polypropylene, polyester, nylon or like strapping.

Transversely disposed locking loops 204 are provided on the bag for securing the first and second loops 202 and 203 in an "interlocked" condition so that the discharge means is held against the side of the bag until it is desired to discharge the goods from the bag, and are described as made of woven polypropylene, nylon, polyester or like strapping. Locking loops 204 are preferably permanently attached to the bag side at an intermediate portion, with both ends being free to be releasably attached to one another (by hook and loop fastener material, snaps, buttons or the like) over and essentially around a corresponding second or side loop 203.

In use, the discharge chute is folded to the side of the bag, corresponding sets of bottom and side loops 202 and 203 are interlocked with each other on the side of the bag and a corresponding locking loop 204 for each set is secured over each side loop 203 before the bag is filled through opening 104. A filled bag is discharged by suspending it over a receptacle into which the goods are to be discharged. There suspended, locking loops 204 and side loops 203 are released and the weight of the goods pushes the discharge means downwardly and causes the contents of the bag to be either discharged through an open flap-end discharge (of the type shown in FIG. 8) or through a discharge chute which has been opened.

In FIG. 2, a particular means of closure for the discharge chute is illustrated for providing additional security against inadvertent discharge of the contents of the bag, in the form of a remotely releasable drawstring 301. Drawstring 301 extends circumferentially around the discharge chute opening through loops 302. When drawstring 301 is pulled tight, the discharge chute opening is closed and excess length is secured to the side of the bag by a strap of material 303, one end of which is releasable so as to permit the drawstring to extend about the full circumference of the discharge chute opening in a full-open condition when it is desired to discharge the contents of the bag into a receptacle. Until released, the drawstring 301 in FIG. 2 is maintained in a tightened position by rope-lock 304, with rope-lock 304 being described in turn as remotely releasable by means of lanyard 305. One end of lanyard 305 is attached to the rope-lock 304 and the other is attached to the side of the bag at a point which would be covered by the discharge chute when the chute is secured to the side of the bag in a fill and transport/non-discharge position.

Figure 3:
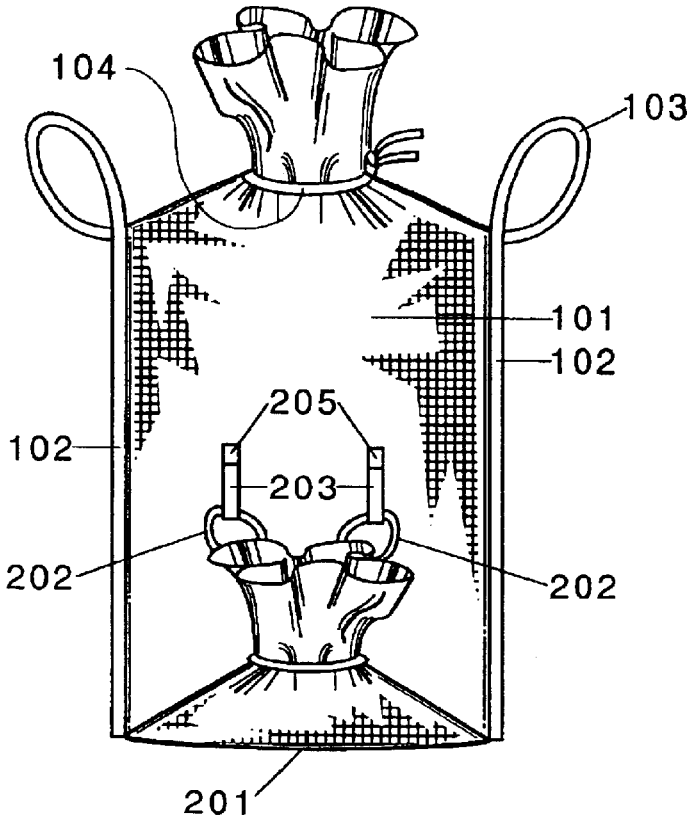
FIG. 3 is a plan view of the front of a preferred side discharge bag otherwise as shown in FIG. 1, but which employs the interlockable first and second loops and strap securing means of the present invention.

Turning now to the remaining FIGS. 3 through 8, the improvement offered by the present invention may now be clearly understood. In FIG. 3, the second or side loops 203 are secured in an interlocked condition with the first loops 202 by a strap 205 having a first end securely attached to the bag side above the interlocked first and second loops, and having a second end which is releasably attached to the second loop. The releasable attachment of a strap 205 to the corresponding second loop 203 may be accomplished as in other instances, through the use of hook and loop-type fastening material, by snaps, buttons or the like, though preferably in all cases the means adopted will be amenable to being released remotely by an operator standing to the side of the bag and the receptacle beneath the bag. Hook and loop-type fastening material is more preferably used.

Figure 4:
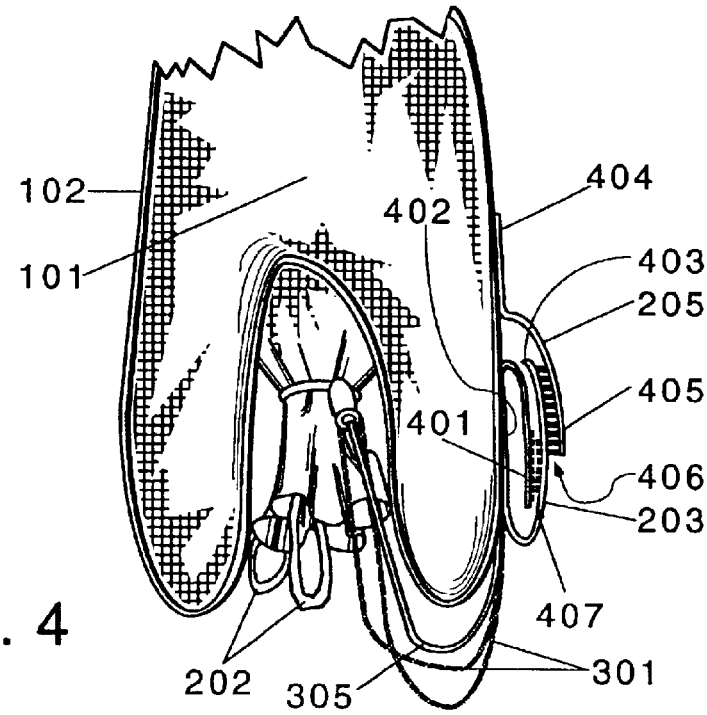
FIG. 4 is a side view of a bag constructed according to the present invention and which utilizes the interlockable first and second loops and strap securing means shown in plan view in FIG. 3, except that in FIG. 4 the first and second loops interlock at generally a bottom edge of the front side. For clarity of illustration and explanation, one such second loop and associated strap securing means are shown in profile, intact but not in interlocking engagement with a corresponding first loop.

A preferred embodiment is shown in partial cross-section in FIG. 4, wherein a second loop 203 having a first, free end 401, an intermediate portion 402 and a second, free end 403 is shown secured by a strap 205 in a condition to be interlocked with a first, bag-end loop 202. It will be observed that the second, side loops 203 and corresponding first, bag-end loops 202 in FIG. 4 are positioned so that they interlock generally at the bottom edge of the front side of the bag, whereas in FIG. 3 the second loops 203 are located higher on the bag side 101 and the discharge means accordingly extends up and is secured to the bag side 101. An expected advantage of the arrangement shown in FIG. 3 is that the lanyard 305, drawstring 301 and rope lock 304 may be completely covered over by the overlapping chute end and made more secure in transport and in suspending the bag over a receptacle for discharge of the goods. Many customers will, however, be limited in terms of headspace above a discharge receptacle, and in this case the arrangement of FIG. 4 is expected to be preferred in that the chute end needs to be long enough only to allow interlocking engagement of the first and second loops 202 and 203 at the bottom edge of the front side of the bag.

Returning now to FIG. 4, as earlier indicated, the strap 205 has a first end 404 which is securely attached (by stitching, gluing, riveting or the like) to the bag side 01 above the second loop 203 when the bag is suspended above a receptacle and a second end 405 which is free from the side 101 of the bag. Strap 205 is equipped on an interior, bag facing surface at its second end 405 with one element of a hook and loop-type fastener pair 406, said element matching up with the corresponding mating element of the fastener pair on the second end 403 of the second loop 203. It can be observed from the drawings that the corresponding mating element of the fastener pair on the end 403 is on the bag-facing, interior surface of the loop 203 when the loop 203 is open as shown in FIGS. 6 and 7 in particular.

The second loop 203 according to a preferred embodiment of the present invention is securely attached to the bag side 101 at its intermediate portion 402, and ends 401 and 403 (just discussed) are free of the side of the bag. The first end 401 carries one element of a second hook and loop type fastener pair 407 for forming the second loop 203, which is also on a bag-facing, interior surface when the loop 203 is opened (see FIG. 7 for a fully-opened view, FIG. 6 for a view wherein the loop 203 has been opened but wherein the first end 401 hangs down loosely over the intermediate portion 402). The other, mating element of the assembly 407 is located generally on an outward-facing (when the loop 203 is fully opened) surface of the lower end 403, so that one seeking to disengage the first loops 202 from the second loops 203 would sequentially release the first hook and loop type fastener pair 406 and then the second such pair 407.

Figure 5:
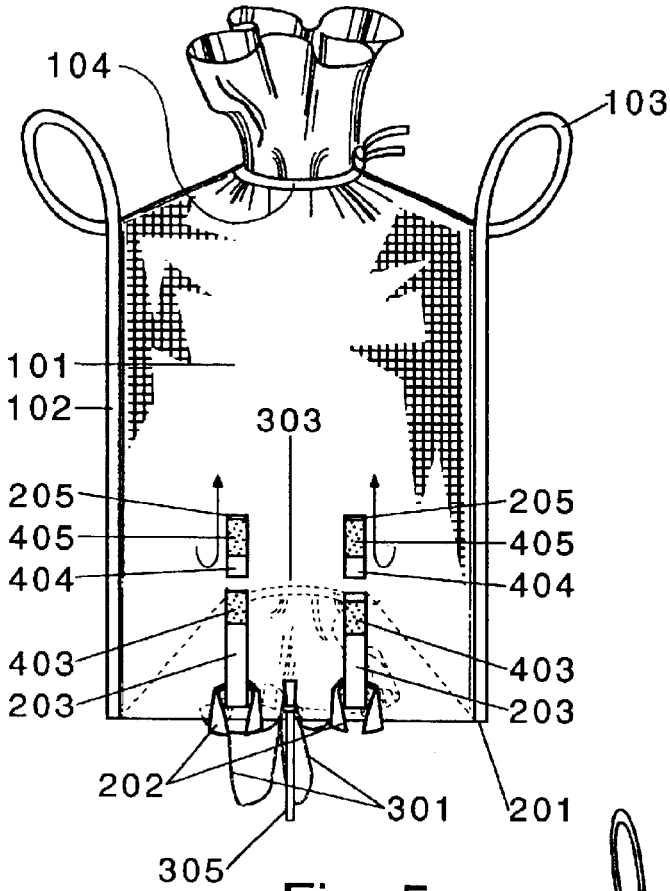
FIG. 5 is a plan view of the bag of FIG. 4, with the strap securing means being folded up and away from their releasable attachment to the second loops, but with the second loops still being formed as loops, intact and in interlocking engagement with corresponding first loops.
Figure 6:
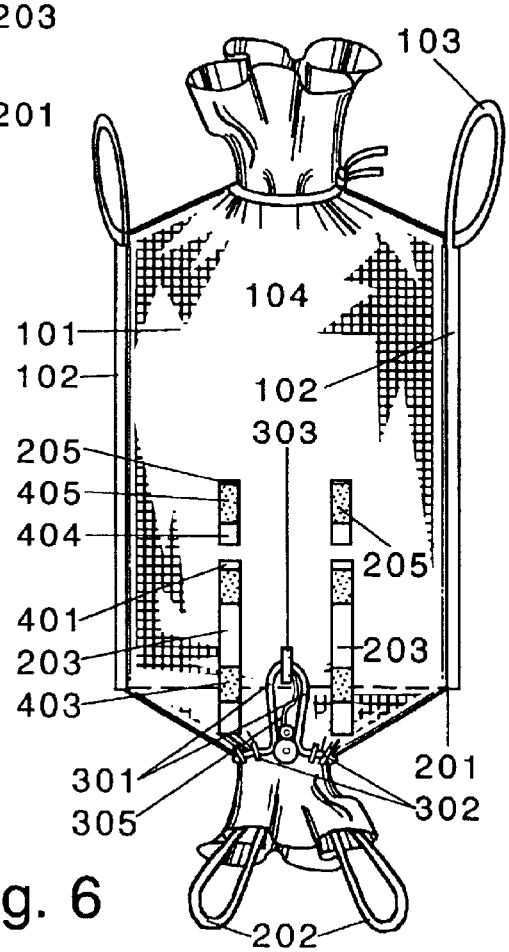
FIG. 6 is a plan view of the bag of FIG. 5, with the second loops now partly opened and the discharge means disengaged from the bag side.
Figure 7:
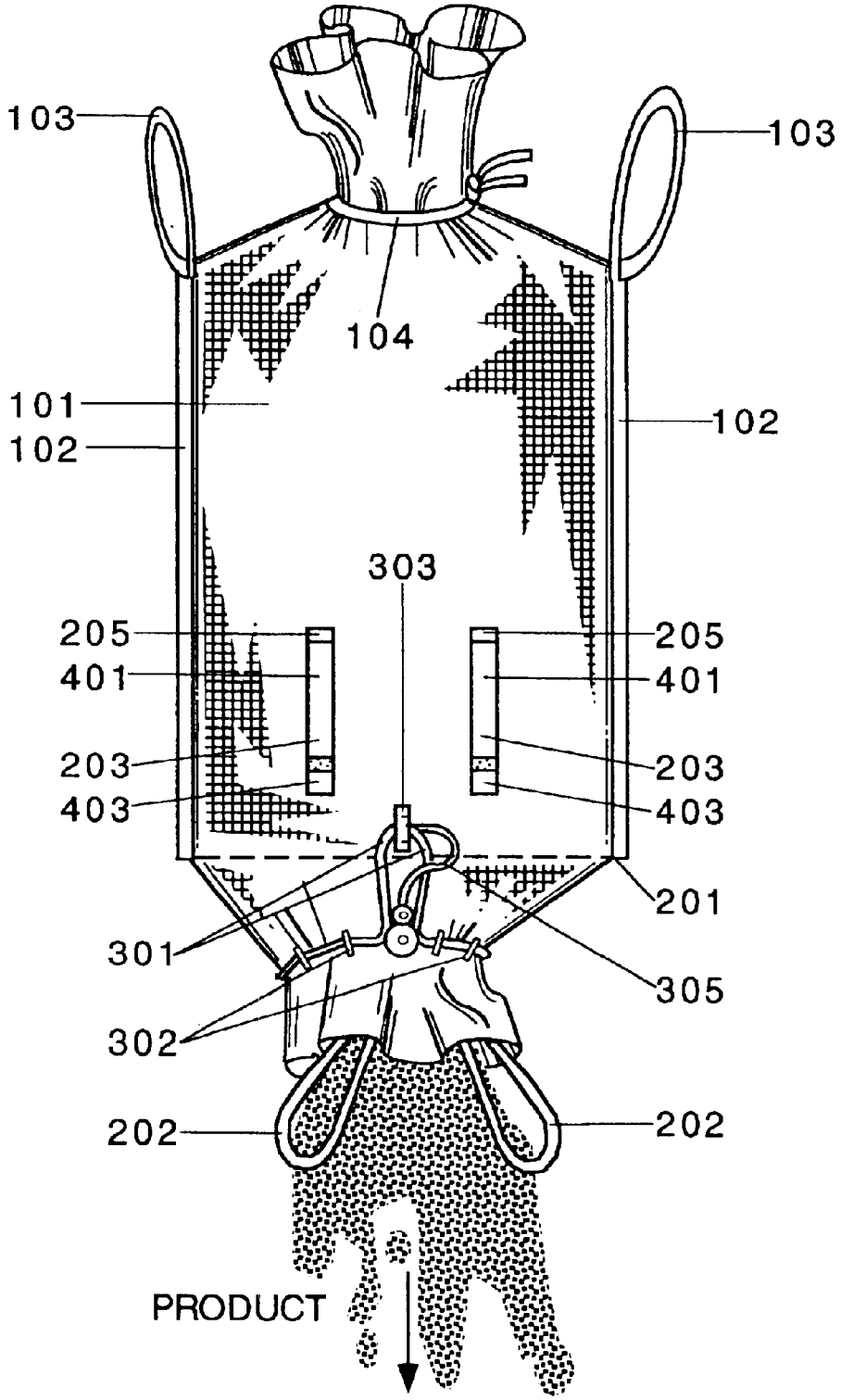
FIG. 7 is a plan view of the bag of FIG. 6, with the second loops now filly opened and the drawstring closure released for discharging product from within the bag.

This manner of operation of the bags of the present invention (whether the bags are as shown in FIG. 3, in FIGS. 4 through 7 or in FIG. 8) is generally evident from FIGS. 5 through 7. In FIG. 5, the straps 205 are disengaged from the still-intact second loops 203, showing the mating elements of the first hook and loop-type fastener pair 406. In FIG. 6, the second fastener pair 407 has been released, the loops 203 are no longer intact, the first loops 202 disengage from the loops 203 and the chute discharge end descends by the weight of the contents of the bag. The element of the first fastener pair 406 on end 403 now faces the bag side 01, and the elements shown on loop 203 correspond to those in the second fastener pair 407. In FIG. 7, the second loop 203 is shown fully opened, with just the element of fastener pair 407 on the end 403 of loop 203 being visible.

After the first and second loops 202 and 203; respectively, are disengaged by opening of the second loops 203, the chute end of the bag (as mentioned) descends into a position to discharge the contents of the bag into a discharge container or receptacle (not shown) over which the bag has been suspended. The lanyard 305 is grasped by an operator to remotely release the rope lock 304, as the weight of the contents of the bag pushes the drawstring 301 open and the bag contents are discharged into the discharge container, as shown clearly in FIG. 7.

In further contrast, however, to the bag of the '753 patent, rather than attaching the lanyard to a loop formed by a strap of fabric 303 having a first end and a second end releasably attached to the first, preferably the lanyard 305 and drawstring 301 in the inventive bags will be tied to a separate, complete (non-opening) loop 303 of material situated at the bottom edge of the side 101 and generally about mid-way between the second loops 203 on the bag side. Preferably a sufficient distance exists between the interlocked first and second loops 202 and 203 on the one hand and the loop 303, so that the first and second loops 202 and 203 can be cleanly disengaged from one another independently of releasing the rope lock 304 by means of the lanyard 305 attached to the rope lock 304. It is also preferred that any excess length of the lanyard 305 and drawstring 301 in a closed condition is minimized to avoid the lanyard and drawstring's themselves becoming snagged or caught inadvertently in filling or emptying of the bag, with the lanyard and drawstring preferably being just long enough to permit the chute discharge end to descend unimpeded into a discharge position (as per FIG. 6), permit the lanyard 305 to be grasped by an operator and allow the discharge chute to be fully opened as the lanyard 305 is pulled.

Figure 8:
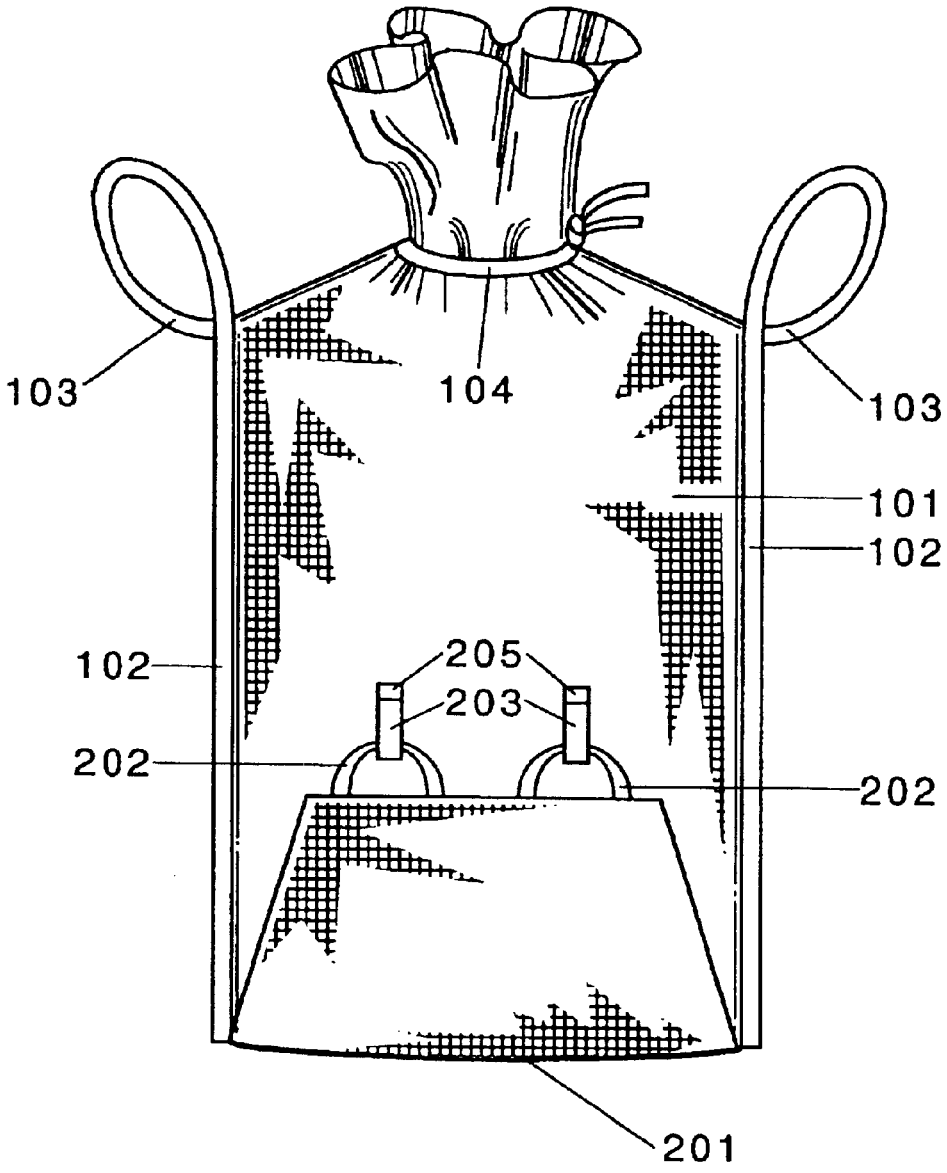
FIG. 8 is a plan view of a side discharge bag like that shown in FIG. 3, but which uses a different, flap end discharge means.

The embodiment of FIG. 8 essentially differs from the embodiments of FIG. 3 and of FIGS. 4 through 7 only in relation to the discharge means employed—being a flap end of the bag as opposed to a discharge chute, and omitting the elements of a closable opening in the form of drawstring closure 301 through loops 302, the loop 303, rope lock 304 and lanyard 305.

What is claimed is:

1. A bulk bag for transportation and handling of flowable goods, comprising:

a) a fabric bag having a top portion as the bag is to be oriented for discharging of the goods within, a plurality of side wall portions and a bottom portion having a designated edge, together defining a storage space therewithin;

b) an opening disposed in said top portion;

c) an opening disposed in said bottom portion;

d) at least one flap of fabric extending from a side wall portion of the bag a sufficient distance to completely cover the opening disposed in said bottom portion and extend at least to said designated edge of said bottom portion when said flap is folded toward said designated edge;

e) a plurality of first loops of fabric attached to a lower edge of the flap portion;

f) for each of said plurality of first loops, a corresponding length of fabric attached securely in at least one location to a side of the bag above the designated edge of the bottom portion, and which includes means for releasably attaching a first portion of the length of fabric to a second portion of the length of fabric to thereby form a corresponding second loop interlockable with a first loop, g) for each of said corresponding second loops, a strap of fabric positioned above the second loop and which has a first, upper end which is securely attached to the bag side wall and a second, lower end which is free from the bag side wall; and h) means for releasably fastening the second, lower end of the strap to a corresponding second loop.

2. A bulk bag according to claim 1, wherein the second loops are positioned just above the designated edge of the bottom portion, so that the first and second loops interlock essentially at the designated edge and the flap does not overlap in a substantial way onto the side wall portion.

3. A bulk bag according to claim 1, wherein the length of fabric for forming the second loop is attached securely to the bag side in an intermediate portion.

4. A bulk bag according to claim 1, wherein the means used for releasably fastening or attaching the various elements includes one or more pairs of mating hook-and-loop-type fastening elements.

5. A bulk bag for transportation and handling of flowable goods, comprising:

a) a fabric bag having a top portion as the bag is to be oriented for discharging of the goods within, a plurality of side wall portions and a bottom portion having a designated edge, together defining a storage space therewithin;

b) an opening disposed in said top portion;

c) an opening disposed in said bottom portion;

d) a fabric chute extending from the bottom portion a sufficient distance to extend at least to said designated edge of said bottom portion when said chute is folded toward said designated edge;

e) a plurality of first loops of fabric attached to said chute proximate a discharge opening thereof;

f) for each of said plurality of first loops, a corresponding length of fabric attached securely in at least one location to a side of the bag above the designated edge of the bottom portion, and which includes means for releasably attaching a first portion of the length of fabric to a second portion of the length of fabric to thereby form a corresponding second loop interlockable with a first loop, g) for each of said corresponding second loops, a strap of fabric positioned above the second loop and which has a first, upper end which is securely attached to the bag side wall and a second, lower end which is free from the bag side wall; and h) means for releasably fastening the second, lower end of the strap to a corresponding second loop.

6. The bulk bag of claim 5, further comprising a drawstring circumferentially surrounding the discharge opening of said discharge chute and which is operable to close off the discharge opening.

7. The bulk bag of claim 6, wherein the drawstring is disposed through a rope-lock which is releasable by a lanyard.

8. A bulk bag according to claim 5, wherein the second loops are positioned just above the designated edge of the bottom portion, so that the first and second loops interlock essentially at the designated edge and the flap does not overlap in a substantial way onto the side wall portion.

9. A bulk bag according to claim 5, wherein the length of fabric for forming the second loop is attached securely to the bag side in an intermediate portion.

10. A bulk bag according to claim 5, wherein the means used for releasably fastening or attaching the various elements includes one or more pairs of mating hook-and-loop-type fastening elements.

* * * * *